US005197432A

United States Patent [19]

Ballheimer

[11] Patent Number: 5,197,432

[45] Date of Patent: Mar. 30, 1993

[54] METHOD OF OBTAINING A LONGER STROKE ON AN EXISTING ENGINE

[75] Inventor: Benny Ballheimer, Peoria, Ill.

[73] Assignee: Caterpillar Inc., Peoria, Ill.

[21] Appl. No.: 878,590

[22] Filed: May 5, 1992

[51] Int. Cl.[5] ..... F02B 75/04

[52] U.S. Cl. ..... 123/48 C; 123/78 C; 123/193.3

[58] Field of Search ..... 123/48 R, 78 R, 78 C, 123/48 C, 193.2, 193.3

[56] References Cited

U.S. PATENT DOCUMENTS

| | | | |
|---|---|---|---|
| 2,113,904 | 4/1938 | Rippe | 123/48 R |
| 2,452,238 | 10/1948 | Hollingsworth | 123/48 R |
| 3,077,189 | 2/1963 | Earnshaw et al. | 123/48 R |
| 3,396,711 | 8/1968 | Fangman et al. | 123/193 |
| 3,418,993 | 12/1968 | Scheiterlein et al. | 123/195 |
| 3,653,369 | 4/1972 | Fangman et al. | 123/193 |
| 3,889,553 | 6/1975 | Ballheimer | 74/579 R |
| 4,174,683 | 11/1979 | Vivian | 123/78 R |
| 4,211,205 | 7/1980 | Lockhart | 123/193 |
| 4,370,901 | 2/1983 | Bolen | 74/586 |
| 4,638,769 | 1/1987 | Ballheimer | 123/41.84 |

FOREIGN PATENT DOCUMENTS 2161580A 1/1986 United Kingdom .

*Primary Examiner*—David A. Okonsky
*Attorney, Agent, or Firm*—Diana L. Charlton

[57] ABSTRACT

Engines are needed to perform a variety of functions in a variety of horsepowers. The subject method of obtaining a longer stroke on an existing engine makes it possible to increase the horsepower capabilities without replacing or modifying the cylinder block or cylinder head. The method includes replacing the existing crankshaft with a crankshaft having a larger throw "T" to increase the stroke length of the engine. In order to compensate for the increased stroke length, a spacer is provided. In addition, the existing connecting rod with the outer swing path "S" is replaced with a connecting rod having an outer swing path "S". In order to avoid interference with the block the existing connecting rod bolts are replaced with connecting rod bolts having reduced diameter shanks and angularly disposing the bolts in relation to a connecting rod axis. The compression ratio os the long stroke engine is maintained substantially equivalent to that of the existing engine by increasing the clearance volume at top dead center within the bore in relation to the increased combustion volume created by the crankshaft having a larger throw "T".

11 Claims, 3 Drawing Sheets

METHOD OF OBTAINING A LONGER STROKE ON AN EXISTING ENGINE

TECHNICAL FIELD

This invention relates generally to engines and more particularly to obtaining a longer stroke on an existing engine.

BACKGROUND ART

Engines are designed to perform a variety of functions and may be used, for example, as power plants for vehicles and generator sets in a variety of output horsepowers.

U.S. Pat. No. 4,638,769 issued to Benny Ballheimer on Jan. 27, 1987 relates to the design and construction of present multipiece block and midsupported liner engines. The patent discloses an engine which includes a multipiece block having a top and bottom portion, a cylinder head, and a midsupported liner. The top block portion and cylinder liner form an annular space therebetween for cooling the combustion area. The top block portion is structurally designed to have a simple profile which is easy to cast, core, and machine, thereby reducing overall costs. In addition, the patent states that a variety of engine sizes can be manufactured on a common machining center with a minimum of component changes through use of this design. By varying the height of the top block portion, the annular space, and the stroke, the horsepower output of the engine can be varied while using the same bottom portion and cylinder head. However, the patent does not disclose the componentry changes which are essential to varying the horsepower output of the engine.

DISCLOSURE OF THE INVENTION

In one aspect of the present invention, a method of obtaining a longer stroke on an existing engine is disclosed. The existing engine has a block defining at least one cylinder bore which has an axis, a cylinder head mounted to the block, a crankshaft rotatably mounted in the block, a cylinder liner disposed within the cylinder bore and having a liner bore, and a piston which reciprocates in the cylinder liner along the axis of the cylinder bore. The piston has a combustion crater and defines a stroke between a top dead center position and a bottom dead center position of the crankshaft. A combustion volume and a clearance volume is provided within the liner bore. A connecting rod is removably attached to the crankshaft and the piston. The steps for obtaining a longer stroke includes replacing the existing crankshaft with a crankshaft having a larger throw "T" and increasing the clearance volume at the top dead center position within the liner bore in proportion to the increased displacement created by the crankshaft having the larger throw "T" in order to maintain a substantially equivalent compression ratio as the existing engine.

In another aspect of the present invention, a method of obtaining a longer stroke on an existing engine is disclosed. The existing engine has a block defining at least one cylinder bore which has an axis, a cylinder head mounted to the block, a crankshaft rotatably mounted in the block, a cylinder liner disposed within the cylinder bore and having a liner bore, and a piston which reciprocates in the cylinder liner along the axis of the cylinder bore. The piston has a combustion crater and defines a stroke between a top dead center position and a bottom dead center position of the crankshaft. A combustion volume and a clearance volume is provided within the liner bore. A connecting rod having an axis and a pair of connecting bolts is removably attached to the crankshaft and the piston. The steps for obtaining a longer stroke includes providing a spacer having a predetermined height between the block and the cylinder head, replacing the existing crankshaft with a crankshaft having a larger throw "T" corresponding to the predetermined height and increasing the clearance volume at the top dead center position within the liner bore in proportion to the increased displacement created by the crankshaft having the larger throw "T" in order to maintain a substantially equivalent compression ratio as the existing engine.

The prior art does not disclose the component changes necessary to produce a longer stroke, higher horsepower engine from an existing engine. The present invention details the method of producing a longer stroke engine and the necessary component alterations. The present invention increases the horsepower capabilities of an existing engine while eliminating the need to replace or modify the cylinder head or block.

BEST MODE FOR CARRYING OUT THE INVENTION

Figure 1:
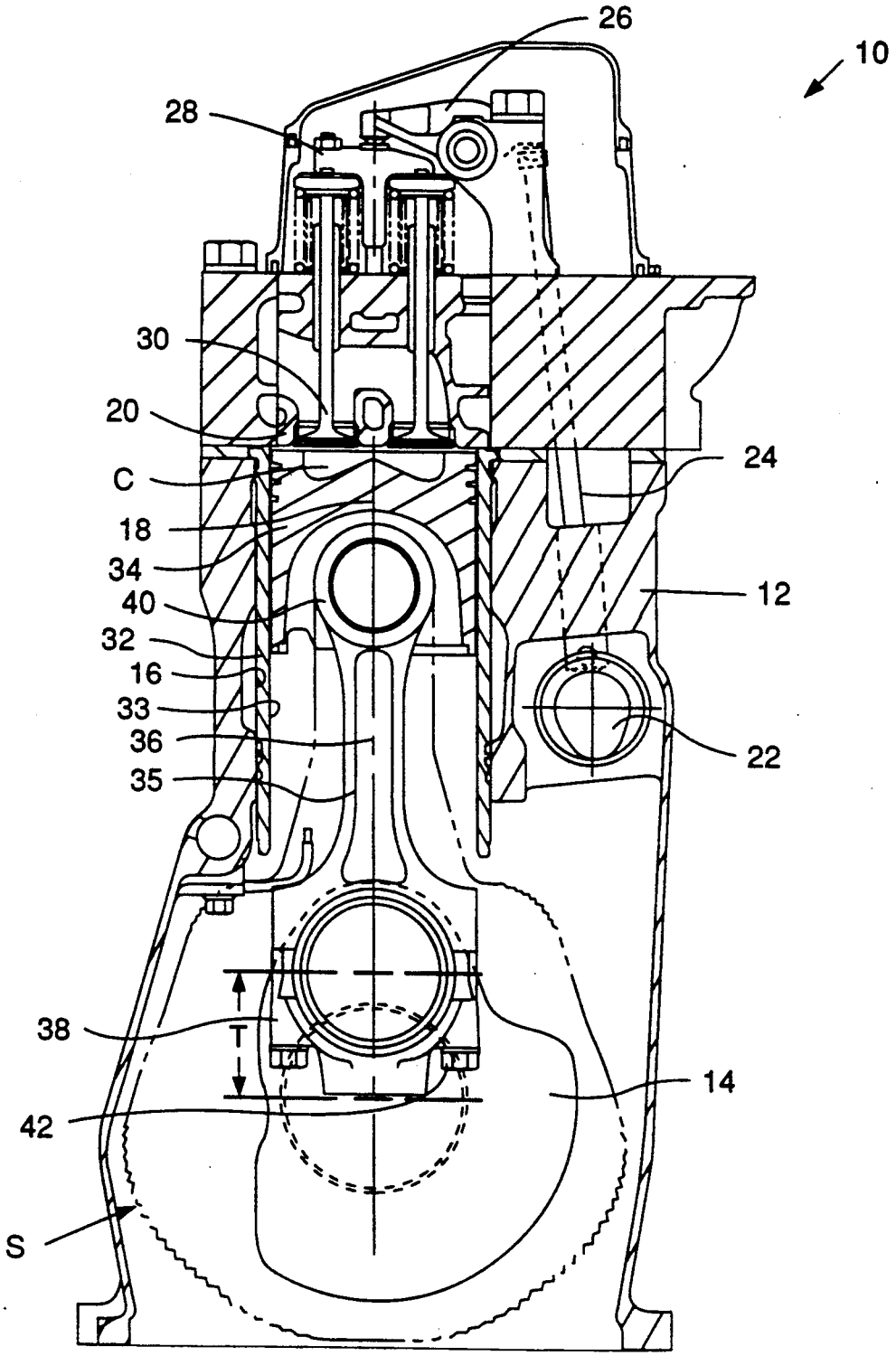
FIG. 1 is a diagrammatic sectional view of an engine.

An existing internal combustion engine 10 is illustrated in FIG. 1. Only a single cylinder has been illustrated and will be described. It should be understood, however, that the invention is capable of use in engines having multiple cylinders and various cylinder configurations.

The engine 10 has a cylinder block 12 rotatably mounting a crankshaft 14 having a throw "T". The cylinder block defines a cylinder bore 16 having an axis 18. A removably connected cylinder head 20 is mounted at the upper end of the cylinder block 12 in a conventional manner. A camshaft 22 is rotatably mounted in the block 12 and is operatively associated with a pushrod 24, a rocker arm 26, and a bridge 28 to operate a plurality of engine valves 30. A cylinder liner 32 having a liner bore 33 is disposed within the cylinder bore 16. A piston 34 having a combustion crater "C" reciprocates in the cylinder liner 32 along the axis 18.

A connecting rod 35 having an axis 36 is removably attached to the piston 34 and the crankshaft 14 in a conventional manner. The connecting rod 35 has a cap portion 38 and a rod portion 40. A pair of connecting bolts 42 removably attach the cap 38 and rod 40 together. The connecting rod 35 traces an outer swing path, illustrated by broken line "S", as it oscillates through a complete revolution of the crankshaft 14.

Figure 2:
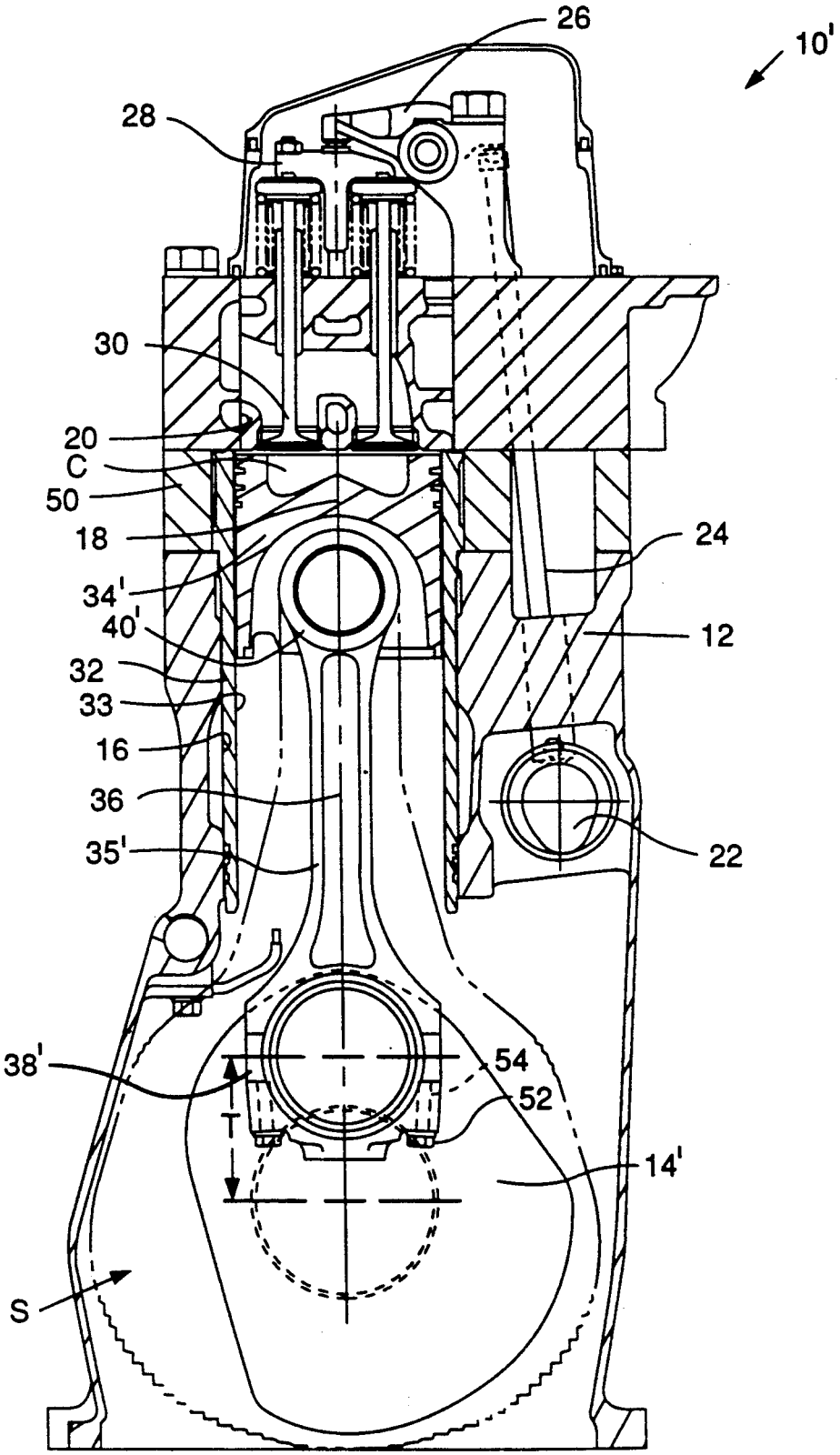
FIG. 2 is a diagrammatic sectional view of an engine embodying the present invention.

An embodiment of an internal combustion engine 10' for the present invention is shown in FIG. 2. It should be noted that the same reference numerals of the existing engine 10 in FIG. 1 are used to designate similarly constructed counterpart elements for the embodiment of FIG. 2 and that primed reference numerals designate that a modification has been made to the counterpart element.

In this embodiment, the crankshaft 14 has been replaced by a crankshaft 14, having a larger throw "T". A spacer 50 having a predetermined height is positioned between the cylinder head 20 and the cylinder block 12 to partially compensate for the longer stroke produced by the crankshaft 14'. The piston 34 has been replaced with a piston 34' having a modified combustion crater volume. The connecting rod 35 has been replaced by a connecting rod 35' having a cap portion 38' and a rod portion 40' modified to accommodate the longer stroke produced by the crankshaft 14'. The pair of connecting bolts 42 have been replaced by a pair of connecting bolts 52 to removably attach the cap 38' and the rod 40' together. The connecting bolts 52 have reduced diameter shanks 54 and are angularly disposed in relation to the connecting rod axis 36. This permits the outer profile of the cap 38' to be decreased in size in order to decrease the outer swing path "S".

In addition to the component modifications mentioned, it should be understood that other component modifications may be necessary depending upon the existing engine configuration. For example, the length of the pushrod 24, cylinder liner 32, fuel lines (not shown), etc. may also be increased to compensate for the longer stroke of the engine 10'.

Figure 3:
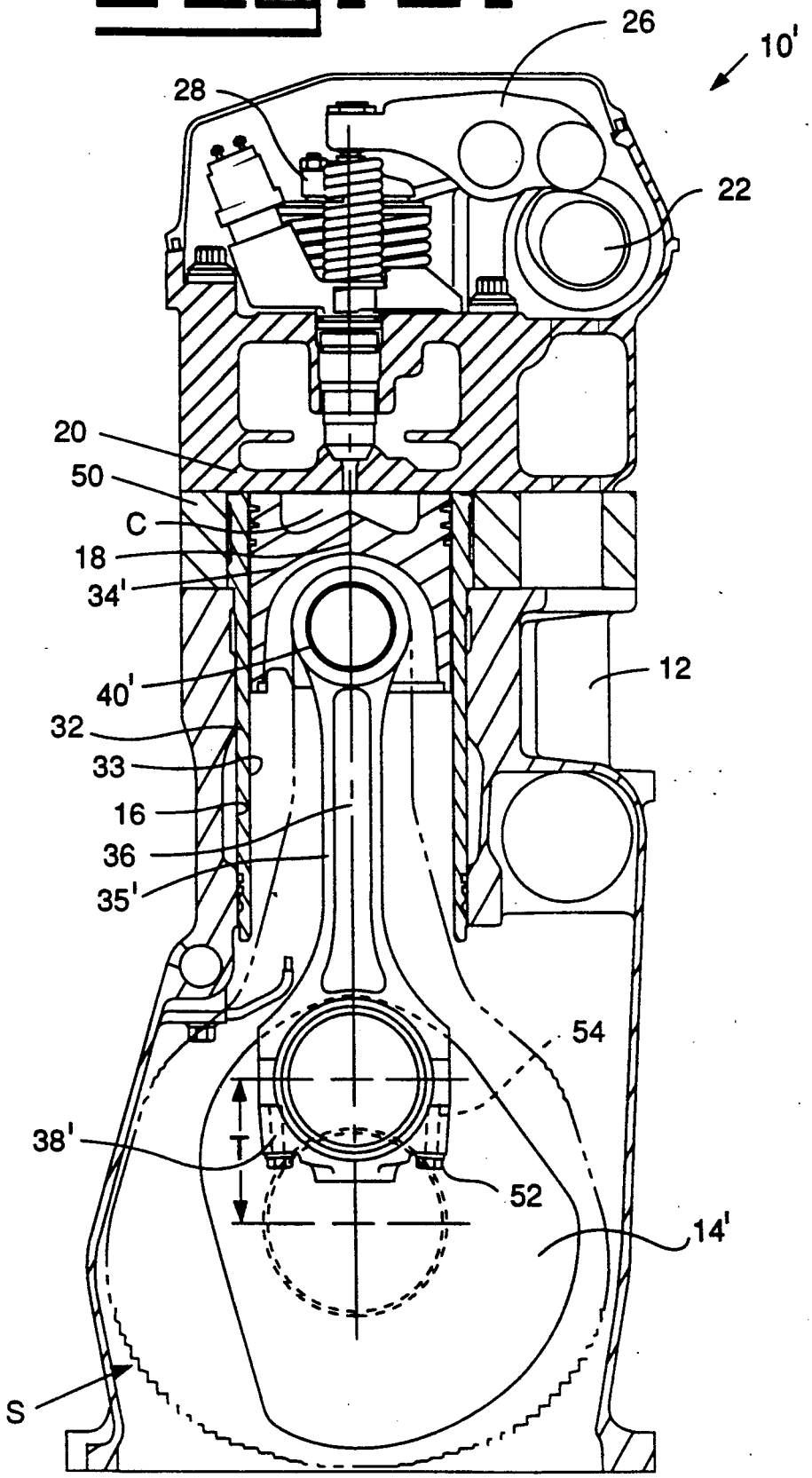
FIG. 3 is a diagrammatic sectional view of another embodiment of the present invention.

Another embodiment of the present invention is shown in FIG. 3. It should be noted that the same reference numerals for the first embodiment of the present invention, shown in FIG. 2, are used to designate similarly constructed counterpart elements for the embodiment of FIG. 3.

In this embodiment, the camshaft 22 is rotatably mounted within the cylinder head 20 instead of the cylinder block 12. The rocker arm 26 is conventionally driven by the camshaft 22 to operate a plurality of valves (not shown). The spacer 50 having the predetermined height is positioned as in FIG. 2 between the cylinder head 20 and the cylinder block 12 in order to partially compensate for the longer stroke produced by the crankshaft 14'. A gear train, not shown, drives the camshaft 22 and crankshaft 14' in a conventional manner.

It should be noted that the replacement of the piston 34 and the connecting rod 35 could occur jointly or separately depending on the existing engine configuration.

Industrial Applicability

In order to better understand the invention, it is relevant to present some commonly known engine definitions including stroke, combustion volume, clearance volume, and compression ratio. The stroke is defined as the distance traveled by the piston from a top dead center (TDC) crankshaft position to a bottom dead center (BDC) crankshaft position. The combustion volume is established by multiplying the stroke times the area of the liner bore. The clearance volume is the minimum combustion volume produced when the piston is at the TDC position of the crankshaft. The compression ratio is defined by dividing the combustion volume by the clearance volume.

To achieve greater horsepower capabilities, the stroke of the engine is increased to gain greater power during normal engine cycles. The throw "T" of the crankshaft generally determines the stroke of the engine. Therefore, to achieve a longer stroke, the crankshaft throw "T" is increased.

Once the larger throw "T" crankshaft 14' is rotatably mounted within the cylinder block 12, the spacer 50 is positioned between the cylinder head 20 and the cylinder block 12. The height of the spacer is preselected to partially compensate for the longer stroke length established by the crankshaft 14'.

During operation of the engine 10, there can be no interference between the connecting rod 35 and surrounding components. Due to the larger throw "T" of the crankshaft 14', the outer swing path "S" would normally increase and interference may occur with the bottom of the cylinder liner 32 or the cylinder block 12 when using the longer stroke engine 10'. However, the connecting rod 35' can be modified in order to decrease the outer swing path "S". This is partially accomplished by replacing the existing connecting rod bolts 42 with connecting rod bolts 52 having reduced diameter shanks 54. In addition, the outer swing path "S" is decreased even further by angularly disposing the connecting bolts 52 in relation to the connecting rod axis 36, generally within the range of 5 to 10 degrees. The angular disposition of the smaller shanked bolts 52 allow the connecting rod 35 to be manufactured with less material on the cap 38" and rod 40' which decreases the outer swing path "S".

It is important for the longer stroke engine 10' to maintain a substantially equivalent compression ratio of that of the existing engine 10 in order for the longer stroke engine 10' to operate as efficiently as the existing engine 10. In order to maintain the compression ratio of the existing engine 10, the clearance volume within the liner bore 33 of the longer stroke engine 10' must be increased in proportion to the increased combustion volume created by the crankshaft 14'. The increase in the clearance volume is determined by applying the relationships mentioned above between stroke, combustion volume, clearance volume, and compression ratio. In order to achieve the increased clearance volume, some component modifications may be necessary. For example, the increased clearance volume can be achieved by decreasing the length of the piston 34 or the connecting rod 35 or modifying the combustion crater volume in the piston 34.

Thus, as described above a method is provided for obtaining a longer stroke of an existing engine having a cylinder block defining at least one cylinder bore which has an axis, a cylinder head mounted to the block, a crankshaft rotatably mounted in the block, a cylinder liner disposed within the cylinder bore and having a liner bore, a piston which reciprocates in the cylinder liner along the axis of the cylinder bore, the piston having a combustion crater and defining a stroke between a top dead center position and a bottom dead center position of the crankshaft, a combustion volume within the liner bore, a clearance volume within the liner bore, and a connecting rod tracing an outer swing path "S", an axis, a plurality of connecting bolts, and being removably attached to the crankshaft and the piston. The method comprises the steps of replacing the existing crankshaft with a crankshaft having a larger throw "T", positioning a spacer having a predetermined height between the block and the cylinder head, and increasing the clearance volume at the top dead center position within the liner bore in proportion to the increased combustion volume created by the crankshaft having a larger throw "T" in order to maintain a substantially equivalent compression ratio as the existing engine. The step of obtaining a longer stroke includes the step of replacing the existing connecting rod with a connecting rod tracing a decreased outer swing path "S". The step of increasing the clearance volume includes the step of replacing the existing piston with a piston having a modified combustion crater volume.

In view of the above, it is apparent that the present invention provides a method for increasing the stroke of an existing engine, thereby, increasing horsepower capabilities, without replacing or modifying the cylinder block or head.

Other aspects, objects, and advantages of this invention can be obtained from a study of the illustrations, the disclosure, and the appended claims.

I claim:

1. A method of obtaining a longer stroke of an existing engine having a cylinder block defining at least one cylinder bore which has an axis, a cylinder head mounted to the block, a crankshaft rotatably mounted within the block, a cylinder liner disposed within the cylinder bore and having a liner bore, a piston which reciprocates in the cylinder liner along the axis of the cylinder bore, the piston having a combustion crater and defining a stroke between a top dead center position and a bottom dead center position of the crankshaft, a combustion volume within the liner bore, a clearance volume within the liner bore, a connecting rod removably attached to the crankshaft and the piston, comprising the steps of:

replacing the existing crankshaft with a crankshaft having a larger throw; and increasing the clearance volume at the top dead center position within the liner bore in proportion to the increased combustion volume created by the crankshaft having the larger throw in order to maintain a substantially equivalent compression ratio as the existing engine.

2. The method of obtaining a longer stroke of claim 1, including the step of:

positioning a spacer having a predetermined height between the block and the cylinder head.

3. The method of obtaining a longer stroke of claim 2, wherein the existing engine has a spacer positioned between the block and the cylinder head, and the step of providing the spacer includes the steps of:

making the predetermined height of the spacer greater than the height of the existing spacer; and replacing the existing spacer with the spacer having the greater height.

4. The method of obtaining a longer stroke of claim 3, wherein the step of increasing the clearance volume within the liner bore includes the step of:

replacing the existing piston with a piston having a modified combustion crater volume.

5. The method of obtaining a longer stroke of claim 1, wherein the step of increasing the clearance volume within the liner bore includes the step of:

replacing the existing piston with a piston having a modified combustion crater volume.

6. A method of obtaining a longer stroke on an existing engine having a cylinder block defining at least one cylinder bore which has an axis, a cylinder head mounted to the block, a crankshaft rotatably mounted in the block, a cylinder liner disposed within the cylinder bore and having a liner bore, a piston which reciprocates in the cylinder liner along the axis of the cylinder bore, the piston having a combustion crater and defining a stroke between a top dead center position and a bottom dead center position of the crankshaft, a combustion volume within the liner bore, a clearance volume within the liner bore, and a connecting rod having a shape tracing an outer swing path, an axis, a plurality of connecting bolts, and being removably attached to the crankshaft and the piston, comprising the steps of:

replacing the existing crankshaft with a crankshaft having a larger throw;

positioning a spacer having a predetermined height between the block and the cylinder head; and increasing the clearance volume at the top dead center position within the liner bore in proportion to the increased combustion volume created by the crankshaft having a larger throw in order to maintain a substantially equivalent compression ratio as the existing engine.

7. The method of obtaining a longer stroke of claim 6, including the steps of:

making a connecting rod having a shape tracing a decreased outer swing path and a pair of connecting bolts;

replacing the existing connecting rod with the connecting rod having the decreased outer swing path.

8. The method of obtaining a longer stroke of claim 7, wherein the step of making the decreased outer swing connecting rod includes the step of:

angularly disposing the connecting bolts with respect to the connecting rod axis.

9. The method of obtaining a longer stroke of claim 8, wherein the step of angular disposing the connecting bolts includes the step of:

disposing the connecting bolts at an angle between 5 and 10 degrees.

10. The method of obtaining a longer stroke of claim 9, wherein the step of increasing the clearance volume within the liner bore includes the step of:

replacing the existing piston with a piston having a modified combustion crater volume.

11. The method of obtaining a longer stroke of claim 6, wherein the step of increasing the clearance volume within the liner bore includes the step of:

replacing the existing piston with a piston having a modified combustion crater volume.

* * * * *